United States Patent [19]

Rutshtein et al.

[11] 3,994,623

[45] Nov. 30, 1976

[54] METHOD AND APPARATUS FOR CONTROLLING A DYNAMIC COMPRESSOR

[75] Inventors: Alexander Rutshtein; Naum Staroselsky, both of West Des Moines, Iowa

[73] Assignee: Compressor Controls Corporation, Des Moines, Iowa

[22] Filed: Feb. 11, 1975

[21] Appl. No.: 548,891

[52] U.S. Cl. ..... 417/19; 417/20; 417/24; 417/23; 417/28; 417/29; 417/47

[51] Int. Cl.[2] ..... F04B 49/00

[58] Field of Search ..... 417/18, 19, 20, 22, 417/23, 24, 26, 28, 29, 47

[56] References Cited

UNITED STATES PATENTS

| | | | |
|---|---|---|---|
| 2,870,716 | 1/1959 | Meneley | 417/20 |
| 2,871,671 | 2/1959 | Bartlett et al. | 417/47 |
| 2,933,236 | 4/1960 | Mathieson | 415/11 |
| 2,961,964 | 11/1960 | Williams et al. | 417/47 |
| 3,068,796 | 12/1962 | Pfluger et al. | 417/18 |
| 3,424,370 | 1/1969 | Law | 415/1 |
| 3,431,858 | 3/1969 | Lynn et al. | 417/22 |
| 3,829,232 | 8/1974 | Fieglein et al. | 415/17 |
| 3,859,006 | 1/1975 | Randell | 415/17 |

*Primary Examiner*—William L. Freeh
*Assistant Examiner*—G. P. LaPointe
*Attorney, Agent, or Firm*—Henderson, Strom & Sturm

[57] ABSTRACT

A method is disclosed for a cascade control of a dynamic compressor to maintain a constant mass flow rate to a process. The method consists of a successive junction of control loops for controlling the speed of rotation, the pressure in the delivery, and the mass flow rate; the output signal of each outer loop being the input signal for the inner loop and each of the loops containing a compensating element to reduce the effects of large time constants of all previous loops.

An automatic control system based on using the above method, distinguished by its great static and dynamic precision in maintaining a controlled parameter, and by the high reliability of protection of the compressor from surge, and protection from a dangerous increase of the speed of rotation and of a dangerous increase of the discharge pressure.

2 Claims, 4 Drawing Figures

METHOD AND APPARATUS FOR CONTROLLING A DYNAMIC COMPRESSOR

BACKGROUND OF THE INVENTION

This invention relates to the methods and means of controlling installations having a dynamic compressor with a turbine driver. The invention relates also to a protective control for a compressor, and more particularly to methods and means for protection from surge and from dangerous discharge pressures or dangerous speed of rotation.

Control systems of dynamic compressors for maintaining a constant mass flow rate have two main functions:

A. Performance control to adjust the speed of rotation of the compressor to the demands of the users process.

B. Protective control to prevent the installation from dangerous and instable conditions of operation, and thereby to protect both the installation and the process equipment from damage.

With regard to performance control it is noted that all the dynamic compressors have what is commonly called a surge limit or surge line above which the performance of the compressor is instable. Such instability results in fluctuations of pressure and flow rates which may cause damage to the compressor.

The surge line is a function of the discharge pressure ($P_2$) and the flow rate of gas through the compressor (G). The location of the surge line of any given compressor, using the coordinates $P_2$, G, is also a function of the molecular weight of gas and of the temperature and pressure of gas in the suction.

Assume here and below that the gas entering the compressor has a stable composition. Then the surge limit can be described by the well known equation:

$$H = a\,(P_2 - P_1), \qquad 1.$$

where:

$H$ = the flow differential in suction;

$P_2$ = the pressure after the compressor;

$P_1$ = the pressure before the compressor;

$a$ = constant coefficient.

According to equation (1), in order to protect the compressor from surge it is necessary and sufficient to fulfill the following condition:

$$H \geq a(P_2 - P_1) \qquad 2.$$

In coordinates $P_2$, G each point of the surge limit line can be defined also as the point of intersection of the horizontal line corresponding to some value of $P_2$, and the curve corresponding to a certain speed of rotation $n$.

Then the equation of the surge limit will be:

$$n = f(P_2, \gamma), \qquad 3.$$

where $\gamma$ is the specific weight of gas in suction.

This method of defining the surge limit can be used in cases when the characteristics of a compressor have slope which is not too small in a zone close to the surge limit. The condition for the safe operation of the compressor in this case can be described by the following relationship:

$$n > f(P_2, \gamma) \qquad 4.$$

All known antisurge systems protect compressors from surge by letting part of the compressed gas into the atmosphere or recirculating it into the suction.

The conditions (2) and (4), however, can be provided not only by blowing off or recycling part of the gas but also by appropriately changing the speed of rotation.

Besides surge, there is considerable danger for the compressor and the process using the compressed gas from an increase of the speed of rotation or an increase in the discharge pressure above certain limits.

It is well known that the dynamic parameters of the transient response of the compressor unit depend considerably on the inertia of rotors of both turbines and compressors and on the volume of the delivery network. Therefore, protecting the compressor from dangerous operating conditions should be made with due regard for both these parameters.

All of the above mentioned types of protective controls are generally passive controls until the pre-established limits have been reached.

In addition to the protective controls, a control is also necessary to adapt the compressor speed of rotation to the varying load requirements of the process for which compressor supplies. In order to fulfill this task, the control system of the compressor should maintain the required constant mass flow rate of gas.

Both of the above mentioned functions of the control system of compressors, i.e. limiting its parameters and changing its speed of rotation in accord with the demands of the technological process, can be accomplished by means of two different methods. According to the first and conventional method, the compressor is controlled by several independent sub-systems, each of which is intended to maintain or limit one definite parameter. Each sub-system can include one or several loops connecting successively.

According to this second and improved method of the present invention, a united control system of a compressor includes several control loops connected together by logical elements. This system is built in such a way that, depending on the changing external conditions (for example the demands of the process, the specific weight of gas in suction), the loops will be connected together differently to form the control circuits for controlling corresponding control members.

If, while using the first conventional method, the resistance of the net of delivery of the compressor changes, then one of the parameters (the discharge pressure or speed of rotation, or the output) can reach the permissible limit. At this moment that control loop which maintains the main controlled parameter, in other words, in this case the flow rate (and which henceforth will be called "the main control loop") and the control loop which limits one of the above mentioned parameters will begin to operate simultaneously and this continues until the moment when the output signal of the main control loop reaches saturation.

It is evident that during all of these periods of the common operation of these two loops until saturation, the main control loop, while maintaining the main parameter, prevents the other control loop from adequately protecting the compressor from approaching to the danger zone. While it is true that during the period of the common operation of the main control loop and the protective controls for speed or pressure (usually short term) the steady state position of the operational point on the field of characteristics of compressor changes insignificantly (which is a positive factor); but, in contrast, the transient response of the control system moves the operational point towards or into a dangerous zone of operation.

After saturation or switching of the output signal of the main control loop, the compressor stays only under the protective control for speed or discharge pressure, and under further growth of resistance of net delivery, nothing can prevent the compressor from moving towards the surge limit line. Thus, a fast growth of the resistance of the net can lead to dangerous consequences.

The above mentioned disadvantages may be eliminated by using a second and improved method which can be accomplished, for example, by means of a cascade control.

The cascade control system is a multi-loop system. Each loop of this system has a separate controller which is adjusted according to the transfer function of the controlled object, the input signal of the object being at the same time the output signal of the above mentioned controller and the output signal of the controlled object being the controlled parameter maintained or limited by this controller.

The number of successively connected loops is chosen according to the number of the controlled parameters.

According to the principal of cascade control, the loops are connected successively and in such a way that the output signal of the first loop controls some control member and the output signal of each outer loop is at the same time the input signal for the following loop.

The method of cascade control permits limiting separate controlled parameters simply and also compensating for the influence of large time constants. As a result, this makes it possible to protect the compressor unit from dangerous operational conditions with considerably higher reliability.

To illustrate this point examination of the compensation for a large time constant will be made by considering the following simple examples.

1. Assume that the controlled object has only one accumulator of energy, an aperiodical component with the transfer function:

$$G^{a.c.}(s) = \frac{k_u}{T_p s+1} \tag{5}$$

It is evident that for full compensation of the time constant Tp, the controller connected directly to a controlled object should have the following transfer function of the proportional-plus-derivative component:

$$G_e \text{P.I.D.}\ (s) = T_p s+1 \tag{6}$$

Physically this means that for momentary changes in the output signal of the controlled object, it is necessary to feed to its input a signal with an infinitely great amplitude. It follows from the above that full compensation is unrealizable in real systems with limited resources.

It is important to add that the degree of compensation is limited not only by the energy sources, but also by the conditions of the noise stability. This is because a considerable increase in the degree of compensation is usually connected with a corresponding increase in interference sensitivity.

The real and sufficient compensation can be achieved by the well known proportional plus reset controller having following transfer function:

$$G_e^{P.I.}(s) = \frac{T_e s + 1}{k_e T_e s} \tag{7}$$

The time constant Te and coefficient $k_e$ should be selected so that:

$$T_e = T_p$$

and $$k_e = k_p$$

Then the transfer function of the open and closed control loops may be simply reduced to the following form:

$$G_{op} = G^{a.c.}(s) \cdot G_e^{P.I.}(s) = \frac{1}{T_e s} \tag{8}$$

$$G_{cl} = \frac{G_{op}}{1 + G_{op}} = \frac{1}{1 + T_e s} \tag{9}$$

2. If the controlled object has not one, but two successively connected aperiodic components, the compensation can be achieved by means of well known proportional plus reset plus derivative controller with following transfer function:

$$G^{P.I.D.}(s) = \frac{(T_1 s+1)\,(T_2 s+1)}{kp\ T_e s} \tag{10}$$

Real objects in the majority of cases are sets of aperiodic components. Their time constants can differ by several orders of magnitudes. For practical purposes, however, it is usually sufficient to compensate for the influence of only those time constants of the highest order of magnitude. The transfer function of real objects can be represented in the following form:

$$G_P(s) = \frac{kp}{(T_p s+1)\pi(\tau_j s+1)} \tag{11}$$

where:

$$\pi\ (\tau j\ s + 1) = (\tau_1 s + 1)\ (\tau_2 s + 1) \ldots (\tau i\ s + 1);$$

where:

$j$ = the ordinal number of the component;

$i$ = the number of components;

$\tau j$ = the time constants, the magnitudes of which differ from the magnitudes $T_p$ on an average by more than on one order of magnitude less.

Then, as mentioned above, it is sufficient to compensate only the time constant $T_p$.

In this case the transfer function of the closed loop (with the control feedback) can be simply transformed to the following form, $$G_{cl}(s) = \frac{1}{T_e s\ \pi(\tau_j s+1)} \tag{12}$$

The magnitude of $T_e$ (Equation 12) is selected according to the conditions of stability:

$$T_o \geq 2 \sum_{j=1}^{i} \tau_j \quad (13)$$

Without great error we can make the following approximation:

$$\pi(\tau_j s+1) \cong \sum_{j=1}^{i} \tau_j s+1 = \sigma s+1 \quad (14)$$

Where:

$$\sigma = \sum_{j=1}^{i} \tau_j$$

Correspondingly, the transfer function of the open and closed control loops will obtain the following form:

$$G_{op}(s) = \frac{1}{T_o s(\sigma s+1)}, \quad (15)$$

$$G_{cl}(s) = \frac{1}{T_o \sigma s^2+T_o s+1}. \quad (16)$$

In other words the compensation in the above examples is accomplished by the replacement of the open loop having a large time constant with a closed loop having a small time constant.

As it follows from the formula (13), the magnitude of the above mentioned time constant is selected with due regard for the sum of the time constants which are not subjected to the compensation.

Therefore, the problems of controlling the dynamic compressor can be solved by means of this invention, which provides for a cascade control of the parameters of the compressor, a limiting of the minimal admissible flow rate through it, and a limiting of the speed of rotation and of the discharge pressure.

SUMMARY OF THE INVENTION

The main purpose of this invention is to control the mass flow rate of compressed gas with a high transient and steady state precision; and, to limit the discharge pressure, speed of rotation and minimal admissible output with high reliability, and with a practical absence of deviations during such transient process.

The main advantage of this invention is the considerably higher reliability of control of the compressor unit while operating closely to the permissible limits. This advantage permits an expansion of the safe operating zone of the gas dynamic characteristics of the compressor and also increases the safety of operation of the process using the compressed gas.

According to the present invention the dynamic compressor with turbine drive is controlled by an automatic system of cascade control. This system includes the following loops: a loop of mass flow rate, a loop of discharge pressure, a loop of speed of rotation, a loop of minimal admissible flow rate through the compressor, and loops of control members. These enumerated loops are connected together so that the set point for the control member of the turbine is made by the loop of speed of rotation; the set point for the loop of speed of rotation is developed either by loop of the discharge pressure or by loop of minimal admissible flow rate through the compressor; the set point for the loop of discharge pressure is developed by the loop of mass flow rate; the set points for the loops which control the blow-off valves are developed by discharge pressure loop or the mass flow rate loop. Depending on the external conditions, the loops are successively connected between themselves in required order. The loops form the control circuits for controlling separate control members, these control circuits being operated in parallel.

An object of this invention is to operate a compressor control system in such a way as to compensate for the disturbing influences of inertia on the rotor of a compressor unit and for the volume of the net delivery.

Another object of this invention is to provide a highly reliable means for limiting the speed of rotation and limiting the discharge pressure.

A further object of this invention is to provide a method and apparatus to limit the minimal flow rate through a compressor by appropriately changing the speed of rotation, while maintaining the desired mass flow rate of the gas to the user by the blowing off or recycling of gas from the discharge to the suction port.

Other objects, advantages and novel features of the invention will become apparent from the following detailed description of the invention when considered in conjunction with the accompanying drawings.

DETAILED DESCRIPTION OF THE INVENTION

Figure 1:
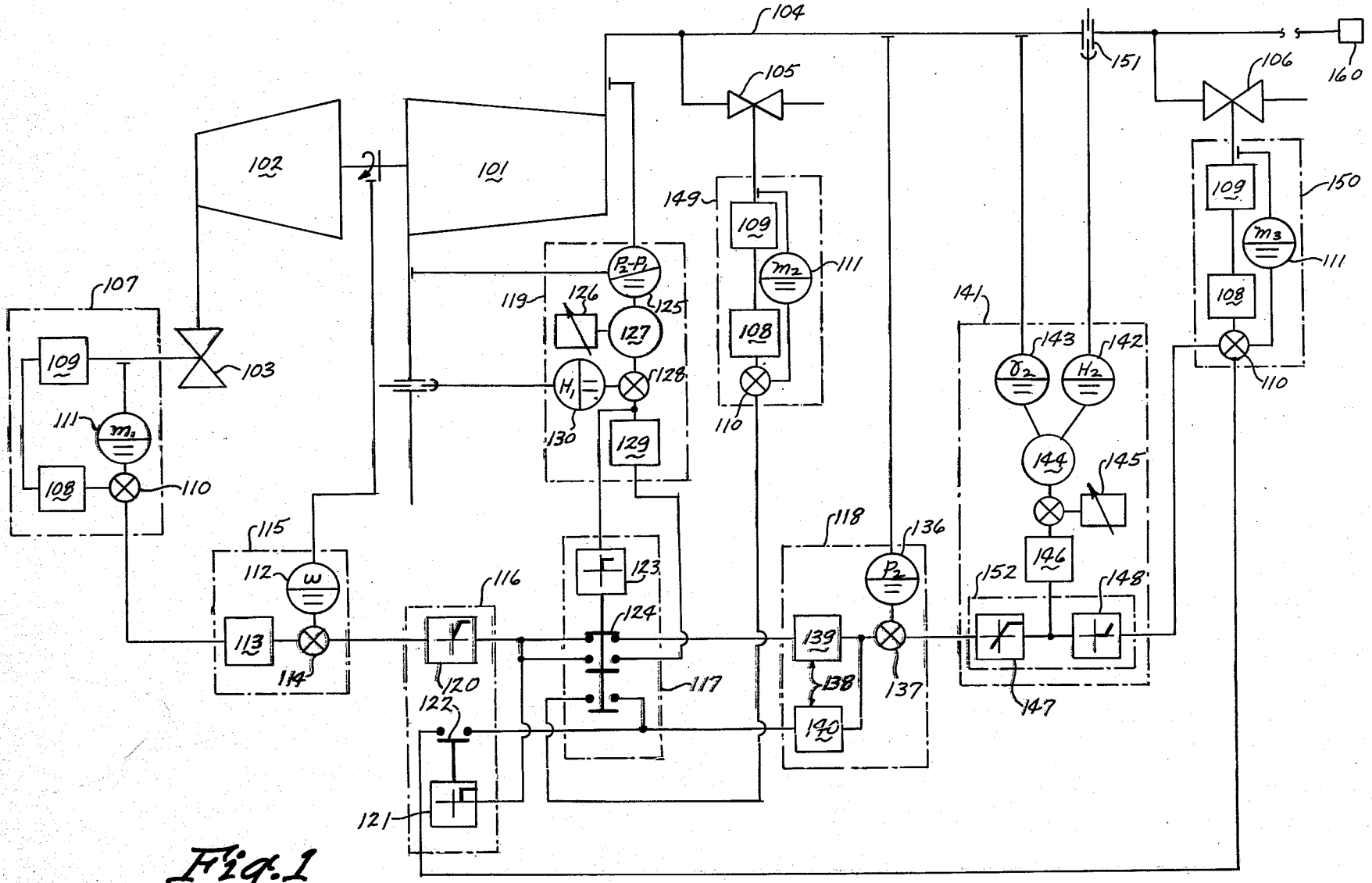
FIG. 1 is a schematic diagram of the control system of the compressor.

Referring now to the drawings, FIG. 1 shows a compressor installation with the control system of the present invention. The installation includes, for example, a dynamic compressor 101 for compressing the gas, a turbine drive 102 having a steam distribution system 103, and a pipeline 104 connecting the compressor 101 with a user 160 of compressed gas. The pipeline 104 is supplied by two blow-off valves 105 and 106.

The control system shown in FIG. 1 is a multi-loop system using a cascade control. The first loop 107 of this system is for controlling the steam distribution system 103. The loop 107 includes a position controller 108, an actuator 109, a comparator 110 and a position transmitter 111.

The position transmitter 111 measures the position of the actuator 109 and sends its output signal to the comparator 110. The comparator 110 compares the actual position of the actuator with a set point, and sends the difference signal to controller 108 as an input signal.

Figure 2:
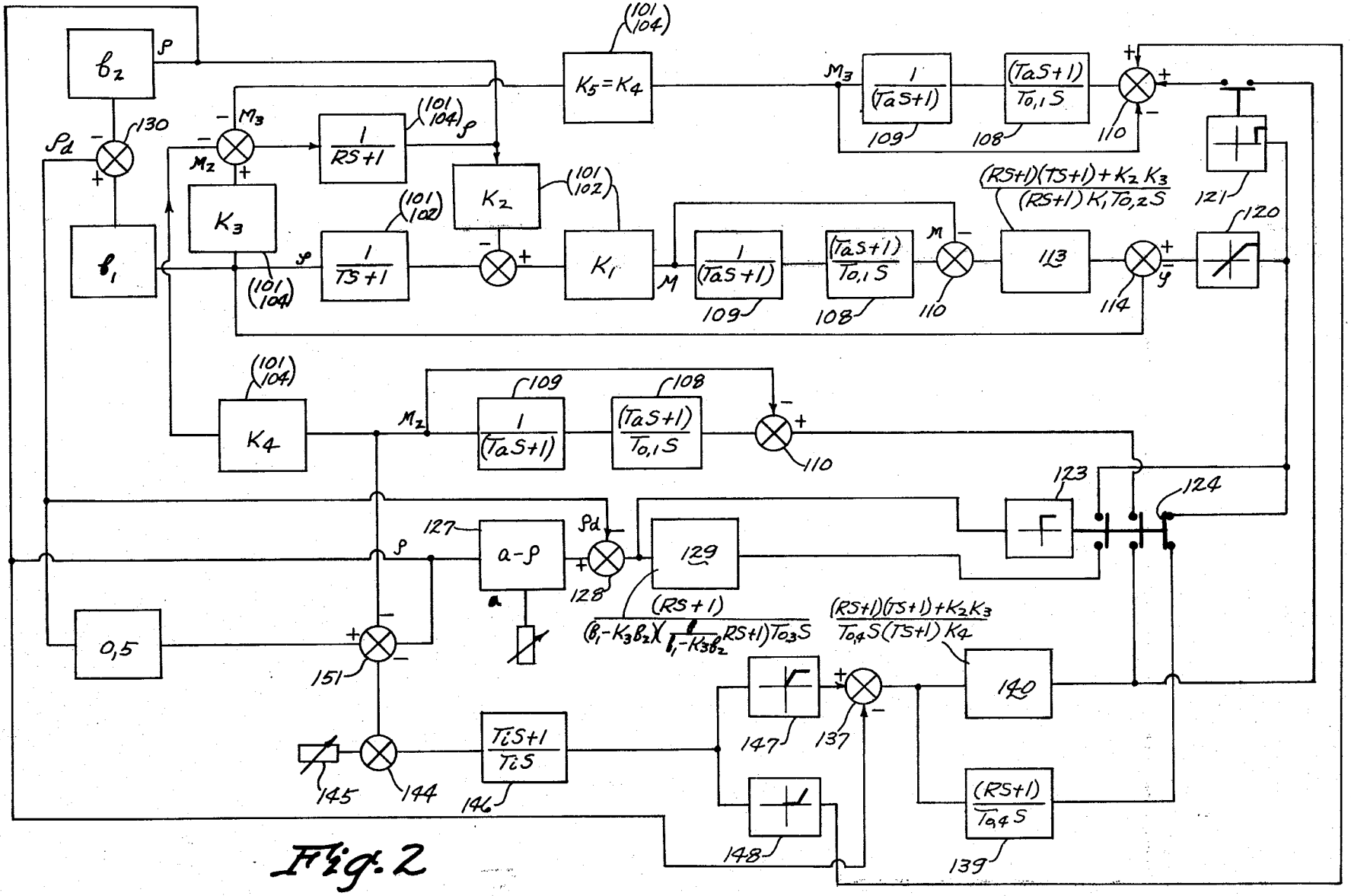
FIG. 2 is a block-diagram of the compressor control system shown in FIG. 1.

According to FIG. 2, wherein the numbers in brackets shown in FIG. 2 correspond to the elements shown in FIG. 1, the transfer function of the actuator 109 is $$G_{ac}(s) = \frac{1}{T_{1,a}s+1}, \quad (17)$$

where:

$T_{1,a}$ = the time constant of the actuator 109.

The actuator 109 is well known aperiodic component. In order to compensate the time constant $T_{1,a}$ the transfer function of the controller 108 is selected according to formula (7):

$$G_{1,c}(s) = \frac{T_{1,a}s+1}{T_{o,1}s}. \quad (18)$$

In formula (18) and below the small time constants which are not subjected to compensation, are supplied with subscript "O". Accordingly, the transfer function of the whole control loop 107 of the steam distribution system 103 can be transformed to the following form:

$$G_{1,cl}(s) = \frac{1}{T_{o,1}s+1} \quad (19)$$

The rest of the control members of the control system (the blow-off valves 105 and 106) have analogous control loops. The transfer function of each of the control members 105 and 106 will be also:

$$G'_{1,cl}(s) = \frac{1}{T_{o,1}s+1} \quad (20)$$

The following control loop of the control system shown on FIG. 1 is the loop 115 for controlling the speed of rotation. This loop 115 develops the set point for the loop 107 and includes a speed transducer 112, a speed controller 113, and a comparator 114.

According to FIG. 2, the transfer function of the controlled object including the turbine 102, the compressor 101, the pipeline 104 and the control loop 107 of the steam distributing system 103 will be:

$$G_{2,sd}(s) = \frac{(Rs+1)k_1}{[(Rs+1)(Ts+1)+k_2k_3](T_{o,1}s+1)}, \quad (21)$$

Where:

$R$ = the time constant of the net of delivery, $T$ = the time constant of the rotors of turbine and the compressor, $T_{o,1}$ = the time constant of the loop 107, and $k1$, $k2$, $k3$ = the constant coefficients.

Correspondingly, the transfer function of the speed controller 113 is selected so that the time constants R and T will be compensated:

$$G_{2,sp,c} = \frac{(Rs+1)(Ts+1)+k_2k_3}{k_1(Rs+1)T_{o,2}s} \quad (22)$$

Then the transfer function of the whole closed loop of speed of rotation can be transformed to the following form:

$$G_{2,cl} = \frac{1}{T_{o,2}s(T_{o,1}s+1)+1} \quad (23)$$

The control loop 115 of speed of rotation receives its setpoint from whichever one of the control loops 118 or 119 which is immediately outer with respect to the speed loop 115, by means of the distributing devices 116 and 117. The control loop 118 is intended to control the discharge pressure, and the control loop 119 is intended to control the minimal admissible flow rate through the compressor 101.

The distributing device 116 includes two channels 120 and 121. The channel 120 is a saturating element. The channel 121 is a relay element. The channel 120 limits the set point for the speed control loop 115 and in this way protects the installation from dangerous increasing of the speed of rotation of the compressor 101. The relay channel 121 is adjusted so that its output signal appears at the moment of beginning of saturating of the output signal of channel 120. This channel 121 of the distributive device 116 controls the switch 122. The distributive device 116, by means of the switch 121, connects the output signal of the pressure loop 118 only with the speed loop 115 until the output signal of the channel 120 reaches the magnitude of saturation. After that, the distributive device 116, by means of channel 121 and switch 122, connects the output signal of the pressure loop 118 also with the control loop 150 of the blow-off valve 106. As a result, the output of compressor 101 is maintained on a constant level during an increasing of the net resistance of the compressor delivery.

The construction of the distributive device 117 and the loop 119 of minimal admissible flow rate can be different. For example, consider the two different versions of construction.

According to first version, FIG. 1, the distributive device 117 includes a relay element 123 and a switch 124. Relay element 123 controls the switch 124 based on a signal corresponding to the difference between the actual and minimal admissible magnitudes of the flow differential in suction. This signal is proportional to the last said difference and this signal comes from the comparator 128.

The switch 124 connects the input of the distributive device 116 with the pressure loop 118 until the flow differential in suction becomes less than its minimum admissible magnitude under the given pressure. After that, the input of the device 116 connects with a loop of minimal admissible flow rate 119 and the output of the pressure loop 118 connects to a loop 149 for controlling the blow-off valve 105.

In this case, the compressor 101 is protected from surge by increasing the speed of rotation, and the mass flow rate of the gas going to the user is maintained at the required level by blowing off compressed gas into the atmosphere or by recycling part of the compressed gas into the suction.

The control loop of minimal admissible flow rate 119, according to the first version, includes a transmitter 125 for sensing the difference of pressure after and before the compressor, a manual set point device 126, a multiplier 127, a comparator 128, a controller of minimal admissible flow rate through the compressor 129, and a transmitter 130 of flow differential in suction.

According to the equation (1), the magnitude of the minimal admissible flow rate through the compressor can be calculated by means of the multiplier 127 receiving signals from the transmitter 125, such signals corresponding to changes in the difference of pressures after and before the compressor.

The multiplier 127 and the transmitter 130 send their output signals to the comparator 128. Comparator 128 develops an output signal for the controller of minimal flow rate 129 and for the relay element 123. According to FIG. 2, the transfer function of the controlled object relating to the considering loop will be:

$$G_{3,mfr} = \frac{(b_l - k_3 b_2)\left(\frac{b_1}{b_1 - k_3 b_2} Rs + 1\right)}{(Rs+1)\,[T_{o,2}s(T_{o,1}s+1)+1]} \qquad (24)$$

Accordingly, the transfer function of the controller 129 of minimal flow rate is selected to compensate the time constant R:

$$G_{3,c} = \frac{(Rs+1)}{(b_1 - k_3 b_2)\left(\frac{b_1}{b_1 - k_3 b_2} Rs+1\right) T_{o,3}s} \qquad (25)$$

In this case, the transfer function of the whole closed loop of minimal flow rate can be simply transformed to the following equation:

$$G_{3,cl} = \frac{1}{T_{3,o}s[T_{o,2}s(T_{o,1}s+1)+1]+1} \qquad (26)$$

The control loop 119 limits the reduction of the flow rate through the compressor depending on the requirements of antisurge protection. Normally this loop should operate in parallel with the pressure loop 118. Both of these loops 118 and 119 mutually supplement each other, increasing the reliability of the protection of the compressor from surge.

During an increasing of the resistance of the discharge network, the loop 119 of minimal flow rate protects the compressor by increasing the speed of rotation, and the pressure loop 118, by blowing off a part of the compressed gas into the atmosphere.

The main and a very important distinguishing feature of the above described method of protective control is that this method protects the compressor from surge even in the absence of the blowing off or recycling aspect of this method.

The second version of construction of the distributive device 117 and the loop 119 can be effectively used in a case when the gas dynamic characteristics of the dynamic compressor have a slope that is not too small.

Figure 3:
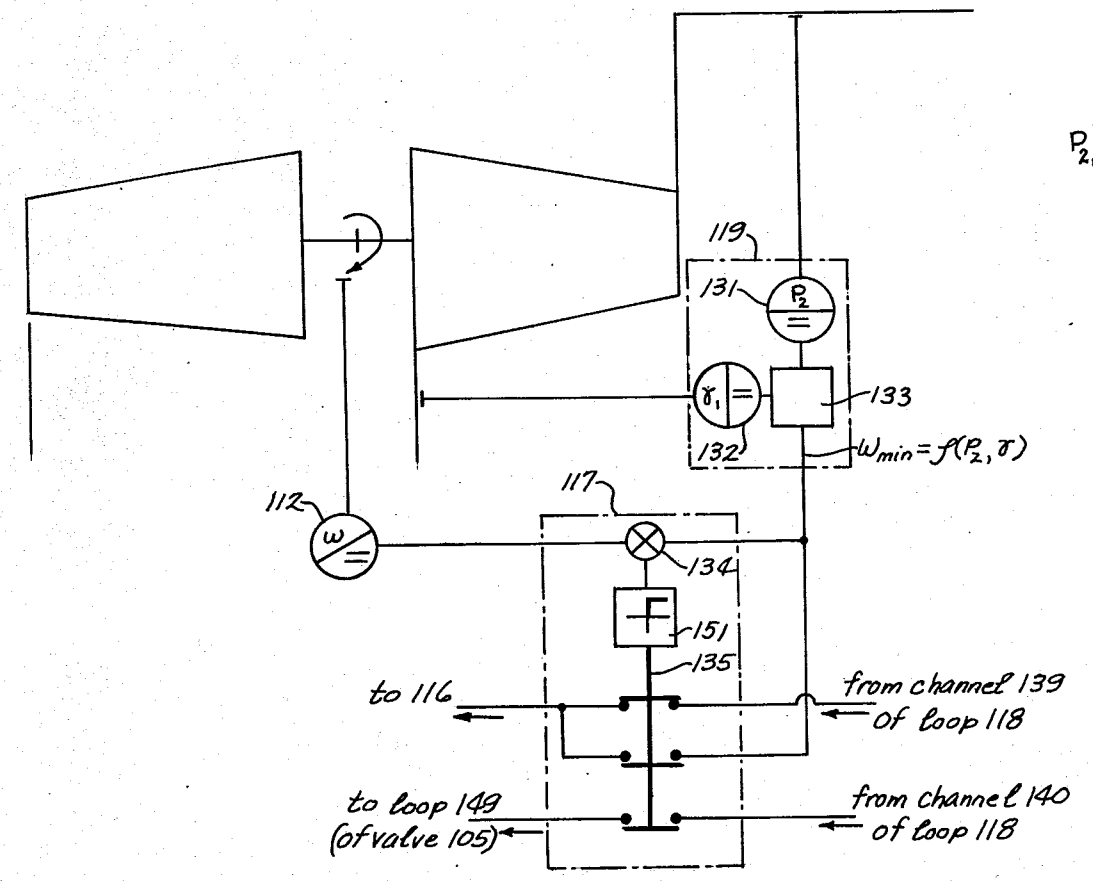
FIG. 3 is a schematic diagram of the control loop for limiting the minimal admissible output of the compressor.

According to this version shown in FIG. 3, a transmitter 131 of pressure measures the pressure in the compressor discharge, a transmitter 132 measures the specific weight of the gas in the compressor suction, and a calculating device 133, based on the minimal admissible magnitude of speed of rotation, develops the set point for the speed loop 115. In this particular case, the minimal admissible speed of rotation, according to the required conditions for antisurge protection, is calculated as a function of the discharge pressure and the specific weight of the gas in the compressor suction (See Formula 3).

The distributive device 117 shown in FIG. 3 includes a comparator 134 and a switch 135. The comparator 134 receives signals from the transmitter 112 and from the calculating device 133, which signals correspond to the actual and to the minimal permissible magnitudes of the speed of rotation, compares these magnitudes and, depending on the result of the comparison, controls the switch 134 by means of a relay 151.

This switch 134, under normal conditions, (which means if the speed of rotation exceeds the minimal level defined by the conditions for antisurge protection) connects the output signal of the pressure loop 118 only with the input of the speed loop 115. But, as soon as the speed of rotation reaches its minimal permissible level, the input of the loop 115 immediately connects with the output signal of the loop 119, and simultaneously, the output signal of the pressure loop 118 connects to the blow-off valve 105 (FIG. 1). The main advantage of this last described version lies in its simplicity.

As shown in FIG. 1, the pressure loop 118 includes a pressure transmitter 136, a comparator 137 and a pressure controller 138 consisting of two channels 139 and 140, each of which is adjusted according to a certain transfer function. Thus, the channel 139, connecting with the speed loop 115, is adjusted according to the following transfer function (See FIG. 2);

$$G^1_{4,pr}(s) = \frac{k_3}{[T_{o,2}s(T_{o,1}s+1)+1]\,(Rs+1)} \qquad (27)$$

Correspondingly, the transfer function of the pressure controller 138 will have the form:

$$G^1_{4,p.c.}(s) = \frac{Rs+1}{k_3\, T_{o,4}s} \qquad (28)$$

Then the transfer function of the whole closed pressure loop can be transformed to the following form:

$$G^1_{p,cl}(s) = \frac{1}{To,4s[T_{o,2}s(T_{o,1}s+1)+1]+1} \qquad (29)$$

A channel 140 of the loop 118 is connected to both blow-off valves 105 and 106 is adjusted in accordance to the following transfer function:

$$G^{11}_{4,p}(s) = \frac{(Ts+1)k_4}{[(Rs+1)\,(Ts+1)+k_2k_3]\,(T_{o,1}s+1)} \qquad (30)$$

Correspondingly, the transfer function of the pressure controller 138 and the whole closed pressure loop 118 can be simply transformed to the following forms:

$$G^{11}_{4,p.c.}(s) = \frac{(Rs+1)\,(Ts+1)+k_2k_3}{k_4\, T_{o,4}s\,(Ts+1)} \qquad (31)$$

$$G^{11}_{4,p.cl}(s) = \frac{1}{T_{o,4}s\,(T_{o,1}s+1)+1} \qquad (32)$$

A loop of mass flow rate 141 (FIG. 1) includes a transmitter 142 of flow differential in the discharge line, a transmitter 143 of the specific weight of gas in discharge, a calculating device 144 for defining the mass flow rate, a set point device 145, a controller of mass flow rate 146 and a distributive device 152 with two channels 147 and 148.

The transmitter 142 measures the flow differential on the section of the pipeline 104 between the two blow-off valves 105 and 106. Therefore, the controller 146 which receives the signals corresponding to the difference between the set point and the actual mass flow rate maintains the flow rate to the user 160 on a constant level even in cases when the blow-off valve 105 is opened.

The channel 147 of the distributive device 152 is a saturating element which develops the set point for the pressure loop 118. The second channel 148 of the distributive device 152 is a nonlinear element with a dead zone. This element 148 is adjusted so that its output signal appears simultaneously with the saturation of the output signal of the channel 147. Channel 148 connects the controller 146 of mass flow rate with the loop 150 for controlling the blow-off valve 106.

According to the above described scheme, an increasing of resistance of net delivery cannot lead to the reducing of the flow rate of the gas through the compressor. When the discharge pressure reaches its maximum admissible level, defined by the adjusting of the channel 147, the signal of controller 146 switches to control the blow-off valve 106. In the case of further increasing of the resistance of the net delivery, the flow rate through the compressor 101 still is maintained on the level which existed at the moment of switching the output signal of controller 146 from the channel 147 to the channel 148.

Figure 4:
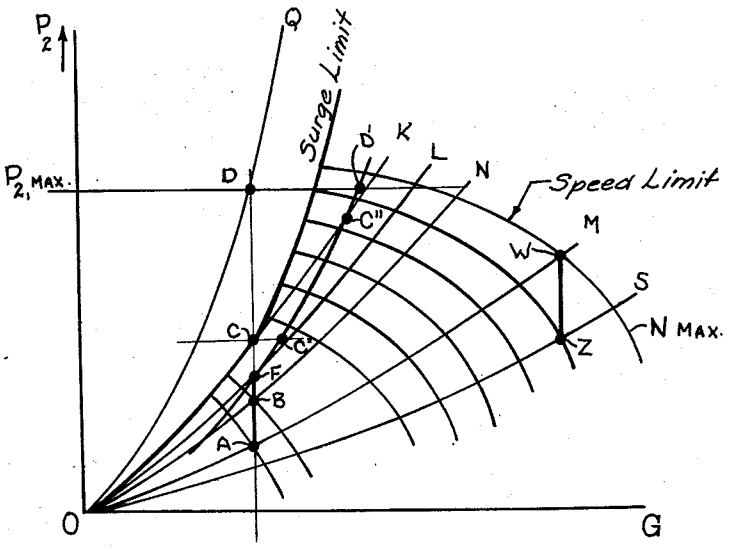
FIG. 4 shows the gas dynamic characteristics of a compressor with the plotted lines of operating conditions and illustrating the lines of minimal admissible output, maximum admissible pressure and maximum admissible speed of rotation.

The operation of the system shown on FIG. 1 can be illustrated by following examples (See FIG. 4).

Assume that at an initial moment the characteristic of the discharge network is defined by the curve OM, and the dynamic compressor works at point A. Then, as a result of the increase of resistance of net delivery the characteristic of the net delivery changes its position and takes the shape ON.

Under such circumstances the compressor immediately shows a tendency to reduce the flow rate. However, the control loop 141, acting through the controller of mass flow rate 146 and channel 147 of the distributive device 152, increases the set point to the pressure loop 118. Correspondingly, the pressure loop 118 through its channel 139 and the distributive devices 116 and 117 begins to increase the set point for the speed loop 115.

With this new set point, the speed controller 113, acting on the steam distributing system 103, increases the speed of rotation of compressor 101 until the required magnitude of the mass flow rate to the user will be restored under the new resistance of the net delivery on line ON in FIG. 4.

If the resistance of the net continues to increase and the characteristics of the net adopts the curve OL, the speed of rotation of the compressor 101 will change by means of the control loops 115, 118 and 141 until the control line AD of the controller 146 of mass flow rate will cross the control line AD′ of minimal admissible flow rate. At this moment the distributing device 117 through the switch 124 simultaneously connects the output signal of the control loop 119 with the spped loop 115 and switches the output signal of the pressure loop 118 from the input of the speed loop to the input of the controlled loop 149 of the blow-off valve 105.

If after that the resistance of net of delivery still continues to rise (and the characteristic of the net of delivery adopts the position OK, FIG. 4), then the control loop 119 of minimal admissible flow rate, according to the equation (1), will begin to increase the flow rate through the compressor 101 by increasing its speed of rotation. Simultaneously, the loop 141 of mass flow rate, while maintaining the constant mass flow rate to the user 160 by means of the control loops 118 and 149, will begin to open the blow-off valve 105. A transient response will continue until the flow rate to the user 160 reaches the required level (point C), and correspondingly the operating condition of the compressor will move to point C′.

However, should the blow-off valve 105 not open for any reason, the operating point of the compressor will move, not to the point C′, but to the point C″. As follows from FIG. 4, in this case the compressor 101 also will be protected from surge by increasing the speed of rotation.

Assume that the resistance of net delivery continues to increase. Then the control system, controlling simultaneously the mass flow rate to the process and the minimal flow rate through the compressor, continues to increase the discharge pressure until such movement when the output signal of the channel 147 of the pressure loop 118 reaches the saturating zone. Beginning from this moment, the output signal of channel 148 appears on the output of the loop 141. Acting on the loop 150, this signal from channel 148 begins to open the blow-off valve 106 in order to maintain a constant flow rate through the compressor 101. In this case the operating condition of the compressor 101 will correspond to the point D′ (FIG. 4) because only this point will simultaneously satisfy the equations of the control lines of both control loops 141 and 119.

Referring now to another example, assume that at an initial moment the dynamic compressor 101 is working in a point Z, and the resistance of net delivery is increasing. In this case the control loop 141 of mass flow rate acts on the loop 118. The loop 118, in turn, by means of distributing devices 116 and 117, acts on the loop 115. The loop 115, in turn, acts on the loop 107 which, by opening the steam valves of the turbine 103, increases the speed of rotation of the compressor 101.

The speed of rotation of compressor 101 will increase until the output signal of the channel 120 of the distributive device 116 reaches the saturating zone. At this moment the output signal of the relay 121 will appear on the output of the distributing device 116, and the switch 122, being controlled by said relay 121, connects the output signal of the pressure loop 118 also with the loop 150 for controlling the blow-off valve 106. Beginning from this moment, the operating point of the compressor 101 will stay at the point W because only this point corresponds at the same time to the control lines of both control loops 141 and 115.

Obviously many modifications and variations of the present invention are possible in light of the above teachings. It is therefore to be understood that, within the scope of the appended claims, the invention may be practiced otherwise than as specifically described.

We claim:

1. A method of controlling a system including a dynamic compressor having a suction port and a discharge port, a turbine driver for said compressor, having a main control member for changing the torque output of said turbine, a pipeline connecting the discharge port of said compressor to a user of gas, a device for measuring the discharge flow differential installed in said pipeline, a device for measuring the suction flow differential installed upstream of the suction port of the compressor and a first and a second fluid relief means connected to said pipeline, the first fluid relief means connected before and the second fluid relief means connected after said measuring device, comprising:

controlling said system by a cascade control of following parameters: a mass flow rate to the user, a discharge pressure, a minimum output of compressor, a speed of rotation, and the positions of said main control member of the turbine and both fluid relief means;

controlling each of said parameters by a separate control loop having its own controller;

connecting said control loops into required control circuits depending upon the pressure and the temperature in the suction port and the pressure in the delivery of the compressor, each of said control circuits controlling a specific control member;

connecting two or more of said control loops together in said control circuits depending upon the external conditions so that the mass flow rate control loop develops the set points only for the pressure control loop and for the loop controlling the position of said second fluid relief; the pressure control loop develops the set point only for the speed loop and for both loops which control the positions of said first and second fluid relief means; the minimum output loop develops the set point only for the speed control loop and the speed control loop develops the set point only for the loop which controls the position of said main control member of the turbine;

compensating for the influence of inertia of the rotors of the turbine and compressor and the inertia of the volume of the discharge network inside of the open control circuit of speed, including the control loop of the position of said main turbine control member, this main control member itself both of said rotors and volume; correspondingly, said circuit of speed being a component with two large time constants; selecting the transfer function of the speed controller to substitute said open circuit of speed for the closed speed control loop with a small time constant; said closed speed control loop including said open speed circuit, a speed controller and a negative feedback of speed;

compensating for the influence of the discharge network volume inside of the open control circuit of the minimum output of the compressor, said open control circuit including the rotors of the turbine and of the compressor, the volume of the discharge network, and said closed speed control loop; said open control circuit of the output of the compressor being a component with one large time constant; selecting the transfer function of a suction flow differential controller to substitute said open circuit of the minimum output of compressor for a closed minimum output control loop with a small time constant; said closed minimum output loop including said open circuits of the minimum output of the compressor, the suction flow differential controller, and a negative feedback of the suction flow differential controller;

compensating for the influence of the discharge network volume inside of the open control circuit for the discharge pressure, said discharge pressure open control circuit including the rotors of the turbine and of the compressor, the discharge network volume and said closed speed control loop, said discharge pressure open control circuit being a component with one large time constant; selecting the transfer function of a discharge pressure controller for substituting said discharge pressure open circuit for a closed pressure control loop with a small time constant; said pressure control loop including said discharge pressure open circuit, said discharge pressure controller and the negative feedback of the discharge pressure;

compensating for the influence of the inertia of the turbine and the compressor rotors and for the discharge network volume inside of the discharge pressure open control circuit, said discharge pressure open control circuit including the rotors of the turbine and of the compressor, the discharge network volume and said first fluid relief means; said discharge pressure open control circuit being a component with two large time constants; selecting the transfer function of the discharge pressure controller for substituting said discharge pressure open control circuit for a closed discharge pressure control loop; said closed discharge pressure control loop including said discharge pressure open control circuit, said pressure controller and a negative feedback of discharge pressure;

limiting the speed of rotation by saturating the set point for the speed control loop; after the set point for the speed control loop has been saturated, under a further increase of resistance of net of delivery, maintaining the compressor output on a constant level by releasing compressed gas from said pipeline downstream from the discharge measuring device by utilizing said second fluid relief means;

limiting the discharge pressure by saturating the set point for the discharge pressure control loop; after saturating the set point for the discharge pressure control loop, and under a further increasing of the resistance of the delivery network, maintaining the compressor output on a constant level by releasing compressed gas from said pipeline downstream from the measuring device by utilizing said second fluid relief means;

limiting the minimum output of the compressor to protect the compressor from approaching the surge limit by changing the speed of rotation so that a given relationship between the pressure differential across compressor and the suction flow differential is maintained;

maintaining a constant mass flow rate to the user while changing the speed of rotation and limiting the minimum output of compressor by releasing excess compressed gas from the discharge port of the compressor by utilizing said first relief means.

2. Control apparatus for controlling the operation of a controlled object comprising a dynamic compressor, a turbine driver of said compressor having a control member for changing the torque output of the turbine, a pipeline connecting said compressor to a user of gas, a discharge flow differential device installed in said pipeline, a suction flow differential device installed upstream from the suction port of the compressor, and first and second fluid relief means for releasing compressed gas from said pipeline downstream from the discharge flow differential device, the first said fluid relief means being connected to said pipeline before the second said fluid relief means being connected after said discharge flow differential device; the improvement comprising:

a control loop for controlling the position of said turbine control member, said control loop including an actuator for the turbine control member, a transmitter for indicating the position of said turbine control member, means for developing a signal responsive to a difference between the actual and the required position of said turbine control member and a proportional-plus-integral controller of the position for said turbine control member; said proportional-plus-integral controller being connected directly to said actuator, the proportional-plus-integral controller and the actuator together having a negative feedback which includes said position transmitter;

a speed control loop for controlling the speed of rotation of the compressor, said speed control loop developing the set point for the position loop of the turbine control member; said speed control loop including a speed transmitter, means for developing a signal responsive to the difference between the actual and the required speed, and a speed controller having a transfer function which represents the sum of the transfer function of a proportional-plus-integral component and the product of the transfer functions of an integral component and an aperiodic component; said speed controller being connected directly to the controlled object, said controlled object including the position loop of the turbine control member, the control member itself and the turbine; the output signal of said controlled object corresponding to the speed of rotation and both the speed controller and the related controlled object together having a negative feedback which includes the speed transmitter;

a control loop for controlling the position of the first fluid relief means which is connected to the pipeline upstream of said discharge flow differential device; said position control loop including:

an actuator for said first fluid relief means, a transmitter for indicating the position of this first fluid relief means, means for developing a signal, which signal is responsive to a difference between the actual and the required position of said first fluid relief means, and a proportional-plus-integral controller of position of this first fluid relief means, the last said proportional-plus-integral controller being connected directly to the actuator of said first fluid relief means and said last proportional-plus-integral controller and the actuator together having a negative feedback which includes said position transmitter of the first fluid relief means;

a control loop for controlling the position of the second fluid relief means, which is connected to the pipeline downstream from the discharge flow differential device, said position control loop including: an actuator for said second fluid relief means, a transmitter for indicating the position of the second fluid relief means, means for developing a signal responsive to a difference between the actual and required position of said second fluid relief means and a proportional-plus-integral controller of position of this second fluid relief means, the last said proportional-plus-integral controller being connected directly to the actuator of said second fluid relief means and the last said proportional-plus-integral controller and the actuator together having a negative feedback which includes said position transmitter of the second fluid relief means;

a control loop of minimum output of the compressor, this minimum output control loop limiting the minimum suction flow differential according to surge protection conditions and said minimum output control loop also developing the set point for the speed loop; said mimimum output control loop including:

a transmitter emitting a signal corresponding to the pressure differential across the compressor, means for multiplying the pressure differential signal by a constant coefficient, and therefore developing a signal corresponding to the required minimum suction flow differential, said means for measuring the flow differential in the suction port, means for developing a signal responsive to a difference between the actual and the required flow differential in the suction port, and a minimum flow differential controller; the transfer function of said minimum flow differential controller being the product of a transfer function of a proportional-plus-integral component and a transfer function of an aperiodic component; said minimum flow differential controller being connected to a controlled object, the last said controlled object comprising the closed speed control loop with its corresponding controlled object and the compressor; the output signal of the minimum output control loop corresponding to the suction flow differential and the minimum flow differential controller and the related controlled object together having a negative feedback which includes a suction flow differential transmitter;

a pressure control loop for limiting the discharge pressure and developing the set points for the speed control loop and also for the control loops for controlling the positions of the first and the second fluid relief means; said pressure control loop including a transmitter of discharge pressure, means for developing a signal responsive to the difference between the actual and required discharge pressure, and a pressure controller; said pressure controller comprising two channels having a common input; the first channel developing the set point for the speed control loop, and the second channel developing the set point for the loops controlling positions of said first and second fluid relief means; said first channel being a proportional-plus-integral component; said first channel being connected to a controlled object, the last said controlled object comprising the speed control loop with its corresponding controlled object and the compressor; the output signal of said controlled object of the first channel of the pressure loop corresponding to the discharge pressure, and the first channel of the pressure controller and the related controlled object together having a negative feedback which includes a discharge pressure transmitter; the transfer function of said second channel representing the sum of the transfer function of a proportional-plug-integral component and the product of the transfer function of an integral component and an aperiodic component; said second channel being connected to first and second controlled objects; said first controlled object being related to the second channel comprising the control loop of the position of the first fluid relief means, said first fluid relief means itself, and the delivery network; the second of said two controlled objects related to the second channel comprising the control loop of the position of the second fluid relief means, the second fluid relief means itself and the delivery network; for anyone of said two controlled objects, the output signal of the respective controlled object of said second channel corresponding to the discharge pressure, and the second channel and any one of said two controlled objects together having a negative feedback which includes a discharge pressure transmitter;

a mass flow rate control loop for controlling the mass flow rate to the user and for developing set points for the pressure control loop and for the control loop for controlling position of the second fluid relief means, the mass flow rate loop including means for measuring the specific weight of the gas in the discharge port, means for measuring the discharge flow differential, means for calculating the actual mass flow rate to the user, means for developing a signal corresponding to a required mass flow rate, means for developing a signal responsive to the difference between the actual and the required mass flow rate to the user, a mass flow rate controller and a distributing device having two channels: the first channel of said distributing device being a saturating element connecting the mass flow rate controller to the pressure control loop, whereby saturation of the output signal of said first channel corresponds to the maximum permissible discharge pressure; the second channel being an element with a dead zone; said second channel connecting the mass flow rate controller to the control loop for controlling the position of the second fluid relief means, the output signal of the second channel appearing when the output signal of said first channel becomes saturated;

a first distributive device for saturating the set point for the closed speed control loop, said set point being developed by the first channel of the discharge pressure controller or by the minimum output control loop, said first distributive device connecting the output signal of said second channel of the discharge pressure controller with the input of the control loop for controlling the position of said second fluid relief means simultaneously with the beginning of the last said saturation;

a second distributing device for connecting the output signals of the pressure or of the minimum output control loops, depending upon the pressure differential across the compressor, to the speed control loop or to the control loop for controlling the position of said first fluid relief means;

said second distributive device connecting the input of the speed control loop to the output of the first channel of the pressure controller until the suction flow differential reaches its minimum admissible magnitude corresponding to the actual pressure differential across the compressor, at which time said input of the speed control loop is switched to the output of the minimum output control loop, and the output of the second channel of the pressure controller is connected to the control loop for controlling the position of said first fluid relief means.

* * * * *